US006629401B1

(12) United States Patent
Hins et al.

(10) Patent No.: US 6,629,401 B1
(45) Date of Patent: Oct. 7, 2003

(54) METHOD FOR THE STERILE PACKAGING PRODUCTS, NOTABLY FOOD OR BEVERAGES, IN POUCHES AND CORRESPONDING POUCH

(75) Inventors: Johannes Hins, Sundern (DE); Rober Elsaesser, Guernligen (CH); Pierluigi Decio, Milan (IT)

(73) Assignees: Georg Menshen GmbH & Co.KG, Finnentrop (DE); Elsaesser Verpackungen AG, Kirchberg (CH); Astepo srl, Collecchio (IT)

( * ) Notice: Subject to any disclaimer, the term of this patent is extended or adjusted under 35 U.S.C. 154(b) by 0 days.

(21) Appl. No.: 09/743,036

(22) PCT Filed: May 4, 1999

(86) PCT No.: PCT/EP99/03051

§ 371 (c)(1),
(2), (4) Date: Mar. 14, 2001

(87) PCT Pub. No.: WO00/66436

PCT Pub. Date: Nov. 9, 2000

(51) Int. Cl.[7] ..... B67B 1/03
(52) U.S. Cl. ..... 53/426; 53/425; 53/468
(58) Field of Search ..... 53/426, 425, 432, 53/468; 215/306, 215

(56) References Cited

U.S. PATENT DOCUMENTS

| | | | | |
|---|---|---|---|---|
| 3,952,902 A | | 4/1976 | Prouty et al. | |
| 4,494,663 A | | 1/1985 | Bertaud et al. | |
| 5,881,536 A | * | 3/1999 | Miiler et al. | 53/426 |
| 5,957,313 A | * | 9/1999 | Bouan | 215/215 |
| 6,142,065 A | * | 11/2000 | Panella et al. | |
| 6,230,472 B1 | * | 5/2001 | Stahlecker | 53/426 |
| 6,256,964 B1 | * | 7/2001 | Drevfors | 53/426 |
| 6,330,780 B1 | * | 12/2001 | Shipway | 53/426 |

FOREIGN PATENT DOCUMENTS

| | | | |
|---|---|---|---|
| EP | 0088 735 A1 | * | 9/1983 |
| EP | 731037 A1 | | 9/1996 |
| EP | 1 067 052 A1 | * | 7/1999 |

* cited by examiner

*Primary Examiner*—Eugene Kim
*Assistant Examiner*—Sameh Tawfik
(74) *Attorney, Agent, or Firm*—Birch, Stewart, Kolasch & Birch, LLP

(57) ABSTRACT

A method of packaging fluid or powdery products, in particular foodstuffs or beverages, in an essentially sterile manner in a packaging material in the form of a pouch of foil material having a filler opening closable by a closure cap, said method includes: providing a pouch whereby the closure cap can be placed in a first and second sealing position relative to the filler opening, whereby the closure cap is removable non-destructively from the filler opening in at least the first position; subjecting the interior of the empty substantially flat pouch having the closure cap in its first position to a germ-killing treatment; conveying the pouch having the closure cap in its first position and its interior already subjected to a germ-killing treatment to a filling plant; subjecting the exterior of the pouch having the closure cap in its first position to a germ-killing treatment; removing the closure cap from the pouch; filling the product into the pouch through the filler opening; and re-placing the closure cap on the filled pouch and closing the filler opening by moving the closure cap into its second position. A corresponding flexible pouch is also described.

13 Claims, 1 Drawing Sheet

METHOD FOR THE STERILE PACKAGING PRODUCTS, NOTABLY FOOD OR BEVERAGES, IN POUCHES AND CORRESPONDING POUCH

This application is the national phase under 35 U.S.C. § 371 of PCT International Application No. PCT/EP99/03051 which has an International filing date of May 4, 1999, which designated the United States of America.

BACKGROUND OF THE INVENTION

The invention relates to a method of essentially sterile packaging fluid or powdery products, in particular foodstuffs or beverages, in a packaging material in the form of a pouch of foil material having a filler opening closable by a closure cap, and to a pouch of foil material for use in such method.

It is known to store liquid or paste-like cleaning materials in flexible refill pouches so as to keep an accumulation of packaging materials to as low a level as possible for environmental reasons. Refill pouches of this type may be in the form of pouches that can be cut open or may include a weld pourer element having a closure cap so that it is possible to repeatedly open and close the refill pouch. In this field of application, flexible pouches naturally do not give rise to sterilisation problems. By contrast however, for health reasons and in order to achieve a sufficiently long shelf-life, problems predominate in the packaging of foodstuffs and beverages for human consumption. Until now, such products were mainly stored in rigid containers made of glass or sheet metal because these are easy to sterilise. Such containers can of course be easily recycled. However, a not inconsiderable level of environmental pollution is associated with the collecting of empty containers and the return thereof to a recycling plant. Moreover, the heavy and voluminous containers cause difficulties in regard to the transportation and storage thereof. Consequently, there is a need for a packaging for foodstuffs and beverages in the form of flexible pouches similar to the known refill pouches used for cleaning materials, which can easily be disposed wihout the shelf-life of the foodstuffs or beverages is substantially reduced by use of these flexible pouches. Although in the EP-A-0 661 208, which discloses a method of manufacturing a flexible pouch including a closure cap and the filling thereof in a filling plant, mention is made that the known procedure be suitable for packaging products such as milk, cooking oils and the like, it is not explained how a sufficient shelf-life can be ensured in packages of this type, even if the manufacture of the pouch would be effected in extremely, sterile surroundings and the products were subjected to a sterilisation treatment prior to filling. In addition, there is a tendency in the foodstuff industry to subject foodstuffs to a germ-killing or sterile treatment without invoking long periods of high temperature for various reasons (retention of valuable substances, such as vitamins, no loss of aroma etc.), so that complete freedom from germs cannot be ensured for the product, and consequently correspondingly greater demands on freedom from germs must be applied to the packaging itself.

BRIEF SUMMARY OF THE INVENTION

The object of the invention is to develop a method which complies with the aforesaid demands of the foodstuff industry, in that it now shall be possible foodstuffs and beverages to be stored in flexible pouches in an economic and environmentally friendly manner without the shelf-life being substantially reducing thereby.

The method according to the present invention is characterised by the following steps:

- providing a pouch in which the closure cap can be placed in a first and second sealing position relative to the filler opening, whereby the closure cap is removable without a destruction thereof from the filler opening in at least the first position,
- treating in a germ-killing manner the interior of the empty substantially flat pouch having the closure cap in its first position,
- conveying the pouch having the closure cap in its first position and its interior treated in said germ-killing manner to a filling plant wherein the following further treatment operations are performed:
- treating a germ-killing manner the exterior of the pouch having the closure cap in its first position at least in a portion including the closure cap and the filler opening,
- removing the closure cap from the pouch,
- filling the product into the pouch through the filler opening, and
- re-placing the closure cap onto the filled pouch and closing the filler opening by moving the closure cap into its second position.

The method according to the invention will be explained in more detail hereinafter.

The starting material is a peripherally sealed e.g. a hot sealed, flexible pouch having a pourer insert element permanently attached thereto by welding, this being referred to hereinafter for short, as a weld pourer element, and a closure cap which can be mounted on said weld pourer element by being knocked thereon so as to seal and close a filler opening which is defined by the weld pourer element and provides access to the interior of the pouch. The construction of a preferred pouch suitable for use in the method of the invention will be described in more detail hereinafter. The pouch may, for example, have a volume of between 0.3 and 5.0 1 although this should not be considered as being a limitation on the invention.

The flat empty pouch having a closure cap located in a first of two closure positions, both of which seal the inlet opening, is initially, i.e. prior to further treatment in a filling plant, subjected to a germ-killing treatment, preferably using germ-killing γ-rays, in a radiation station which could be of basically known construction and consequently does not need to be described in more detail. The germ-killing treatment may be effected during the manufacture of the pouch or, if so desired, immediately prior to the entry of the pouch into the filling plant. The purpose of the treatment is to produce a germ-free state, or as germ-free a state as possible, in the interior of the pouch. Since the closure cap occupying its first closure position hermetically seals the interior of the pouch, this germ-free state will be retained for further treatment of the pouch even if a long period of time, e.g. of some days or even several months, should elapse between the germ-killing operation and further treatments.

A number of pouches pre-treated in the manner previously described can be brought together to form a transportation pack for subsequent insertion into a storage magazine of a filling plant, whereby an annular collar on the weld pourer element provides an abutment support by means of which the pouch can be inserted by hand or in some other manner into a rail-like intake of the magazine of the filling plant with the weld pourer element facing upwardly. The pouches are transferred successively from the magazine of the filling plant to a transportation device, whereby the annular collar serves for supporting the pouches during transportation in order to move the pouches one after the other through a plurality stations in which further treatment is effected.

The transportation device preferably comprises a rotary table having a plurality of treatment stations disposed around the periphery thereof. In a first treatment station, the pouch with its closure cap still occupying the first position is subjected to an external germ-killing treatment by being sprayed with a liquid disinfectant by means of a jet on at least that portion of the pouch comprising the closure cap and the weld pourer element. The disinfectant may be any one of the substances known in the food industry so that one may dispense with a more detailed explanation in this regard.

Following the germ-killing treatment of the exterior of the pouch, subsequently there is a drying step in a drying station in which hot air or hot steam is applied to the pouch.

The so pre-treated pouch is transported thereafter to a station in which grippers grasp the closure cap and remove it from the weld pourer element. The removed closure cap is fed into a bypass transportation path and temporarily stored there so that it can be re-placed on the pouch at a later time.

Following thereon, the pouch with the closure cap removed therefrom reaches a filling station in which the product e.g. a foodstuff or a beverage, is introduced into the interior of the pouch through the open filler opening of the weld pourer element.

Thereafter, and prior to the closure cap being re-placed, an inert gas e.g. nitrogen or steam is fed into the interior of the filled pouch in a further station in order to expell any remaining air in the pouch and thereby counteract undesirable oxidation of, or other forms of alteration to, the filling.

Following this treatment, the closure cap is picked up from the bypass transportation path by means of a gripper device in a closing station and re-placed on the filled pouch, and mounted such that the closure cap adopts its second sealing position wherein it either cannot be removed from the weld pourer element or can only be removed therefrom by application of considerable force, possibly destroying the weld pourer element.

If so desired, a drying treatment by hot air or steam may be performed in a drying station following the last treatment step, prior to the filled and hermetically sealed pouch leaving the filling plant for further use.

It is preferred, that the treatment in at least those stations in which the closure cap is removed from the pouch, the pouch is filled with a product and the closure cap is re-placed on the filled pouch, in essentially germ-free surroundings is effected by keeping these handling stations screened from the outer surroundings in so far as possible. The transportation of the pouch through the individual treatment stations and the treatments effected therein may be effected automatically under the control of a process controlling device. Basically, in regard to the construction of such a filling plant and said treatment stations, the skilled person may revert to known means, so that more detailed explanation thereof can be dispensed with.

BRIEF DESCRIPTION OF THE DRAWINGS

A preferred pouch for use in the method in accordance with the invention will be described in more detail hereinafter with reference to the drawings. Therein.

DETAILED DESCRIPTION OF THE INVENTION

Figure 1:
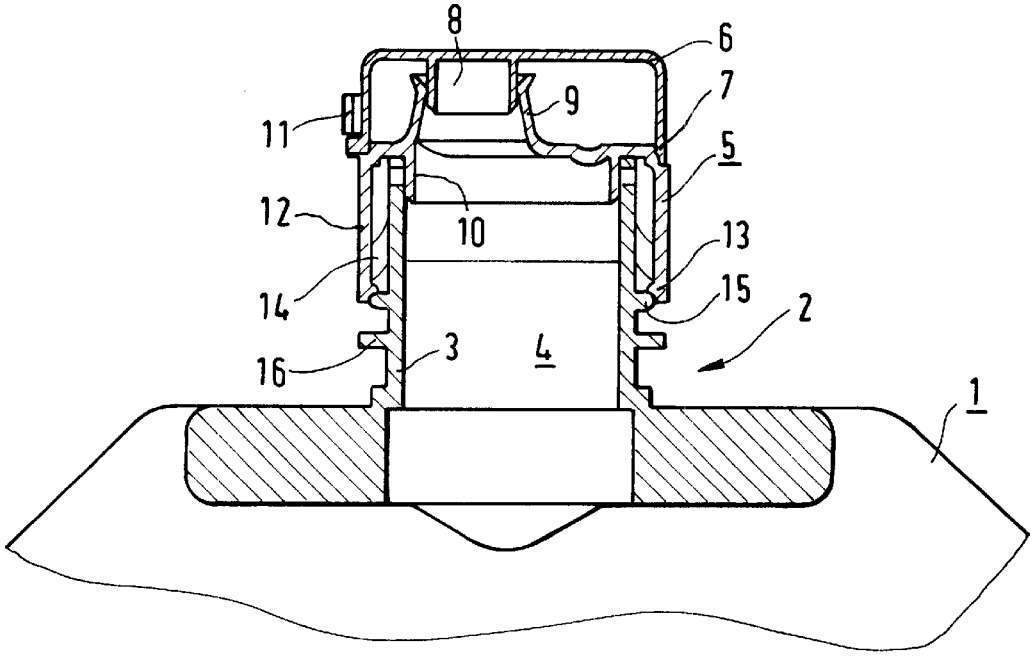
FIG. 1 is a fragmentary sectional view of a pouch in accordance with the invention having a closure cap located in its first position.
Figure 2:
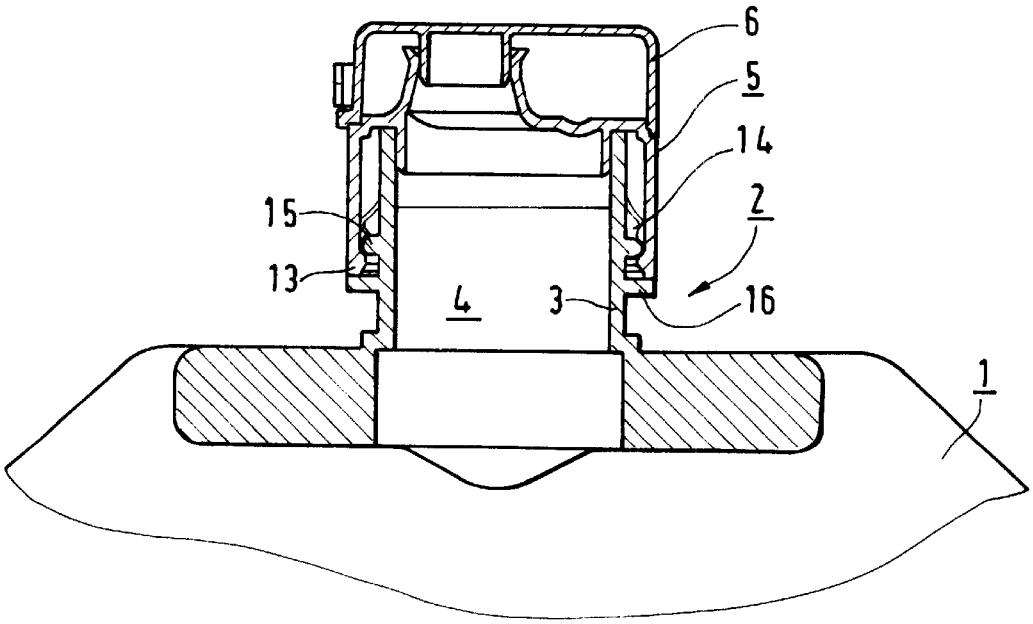
FIG. 2 is a view of the pouch similar to FIG. 1 wherein the closure cap is in a second position.

A pouch base member of the pouch bearing the reference number 1 is shown in FIGS. 1 and 2 in a fragmentary manner. The pouch base member 1 may have a suitable circumferential configuration and may consist of any suitable germ-proof foil material whereby this may be a foil made of plastics or a metal foil e.g. aluminium foil, or a composite foil consisting of plastics and metal. Basically, the pouch in its empty starting state has a substantially flat configuration and it may be printed with advertising slogans.

A dimensionally stable insert or weld pourer element 2 is inserted in a slit-shaped opening (not shown) of the pouch base member 1 at any suitable location around the outer periphery of the pouch base member 1, preferably at a corner portion thereof, and mounted in an hermetically sealing manner to the pouch base member 1 by welding. Although other connecting techniques may be used, the weld pourer element 2 is preferably attached to the bag pouch base member 1 by means of an ultrasonic welding process. Welding ribs (not shown) may be provided on the weld pourer element 2, which may be formed in accordance with the W096/38349, to which reference may therefore be made.

The weld pourer element 2 comprises a tubular neck portion 3 projecting outwardly from the pouch base member 1, said neck portion defining a through passage 4 which provides for a communication between the interior of the pouch base member 1 and the outer surroundings thereof. A closure cap 5 can be placed on the neck portion 3 so as to hermetically close the inlet opening of the neck portion 3 relative to the outer surroundings. A cover member 6 may be hinged to the closure cap 5 by a foil hinge 7. A sealing cone 8 projects from the cover member 7 and can engage in a funnel shaped passage 9 in a bottom wall of the closure cap 5 thereby sealing it when the cover member 6 is in its closed position. A tear-off strip 11 may be provided for maintaining the cover member 6 in the closed position shown in the drawing, so that movement of the cover member from its closed to its open position (not shown) can only be effected after the tear-off strip 11 has been torn off. A further sealing cone 10 may be provided on the closure cap, said cone engaging in the inlet opening of the neck portion 3 so as to seal it when the closure cap is located in the position relative to the neck portion 3 shown in FIGS. 1 and 2.

A somewhat radially inwardly projecting annular collar 13 is provided around the peripheral edge 12 of the closure cap 5 near the free end thereof.

The closure cap 5 can be positioned in two positions relative to the neck portion 3, whereby the through passage 4 is sealed relative to the outer surroundings by the closure cap 5 in both of these positions. The two positions are defined by an engagement of the annular collar 13 of the cap with first and second interlocking portions on the neck portion 3 of the weld pourer element 2. In particular, a plurality of radially outwardly projecting interlocking cams 14 are provided around the outer periphery of the neck portion 3 (only 2 diametrically opposite interlocking cams 14 can be seen in the drawing), these cams being arranged at the same angular spacing from one another. Each of the interlocking cams 14 has an interlocking surface facing in the direction of the pouch base member 1. As is shown in FIG. 1, the annular collar 13 engages with the interlocking surfaces of the interlocking cams 14 in the first position of the closure cap 5.

Furthermore, a radially outwardly projecting interlocking collar 15 is provided on the neck portion 3 near the interlocking cams 14, said interlocking collar 15 being engaged from below by the annular collar 13 when the closure cap 5 is located in its second position, as is shown in FIG. 2.

The interior of the pouch base member 1 is hermetically sealed relative to the outer surroundings in both positions of the closure cap 5. In the first position of the closure cap 5 shown in FIG. 1, a sealing is assisted by the annular collar 13 resting on the interlocking collar 15, in that the latter is arranged near the interlocking cams 14. In the second position of the closure cap 5 shown in FIG. 2, the cap side annular collar 13 engages the interlocking collar 15 from below along its entire periphery whereby the desired sealing effect is produced. The closure cap can no longer readily be removed from the neck portion 3 in its second position. In contrast thereto, the interlocking relationship between the closure cap 5 and the neck portion 3 in the first position is such that the closure cap 5 can be removed from the neck portion 3 with only little effort and without causing any destruction, in that the cap side annular collar 13 is brought out of engagement with the interlocking cams 14.

Furthermore, a radially outwardly projecting annular collar 16 is provided on the neck portion 3 at an axial position between the pouch base member 1 and the interlocking collar 15, said annular collar 16 serving as a holding means for the transportation of the pouch by means of a transporting device into a filling plant (not shown). The annular collar 16 may be continuous or discontinuous. A plurality of peripherally distributed holding noses could be provided as holding means instead of an annular collar.

The invention has been described hereinabove on the basis of a preferred embodiment thereof, and a preferred embodiment of a pouch. However it should be understood that no limitations on the invention should be seen thereby, but rather modifications are included which can be made by a skilled person on the basis of the teaching provided. This applies, in particular, to dispensing with individual treatment steps, provided that the germ-free packaging of foodstuffs and beverages is not affected thereby, or is only affected to an inessential extent.

What is claimed is:

1. A method of essentially sterile packaging fluid powdery products in a packaging material in the form of a pouch of foil material having a filler opening closable by a closure cap, characterized by the following steps:

1.1 providing a pouch in which the closure cap can be placed in a first and second sealing position relative to the filler opening, whereby the closure cap is removable non-destructively from the filler opening in at least the first position, 1.2 subjecting the interior of the empty substantially flat pouch having the closure cap in its first position to a germ-killing treatment, 1.3 conveying the pouch having the closure cap in its first position and its interior already subjected to a germ-killing treatment to a filling point, 1.4 subjecting the exterior of the pouch having the closure cap in its first position to a germ-killing treatment at least at a portion including the closure cap and the filler opening, 1.5 removing the closure cap from the pouch, 1.6 filling the product into the pouch through the filler opening, and 1.7 re-placing the closure cap on the filled pouch and closing the filler opening by bringing the closure cap into its second position.

2. A method according to claim 1, characterised in that the germ-killing treatment of step 1.2 is effected by exposing the pouch to γ-rays.

3. A method according to claim 1, characterised in that the pouch having the closure cap in the first position thereof is subjected to a pre-sterilisation by means of heated steam prior to step 1.4.

4. A method according to claim 1, characterised in that the germ-killing treatment of step 1.4 is effected by applying a disinfectant.

5. A method according to claim 4, characterised in that the surroundings of the closure cap and the filler opening are dried by means of hot air or steam after the application of the disinfectant.

6. A method according to claim 1, characterised in that at least steps 1.5 to 1.7 are carried out in essentially germ-free surroundings.

7. A method according to claim 1, characterised in that a treatment by means of an inert gas or steam is performed prior to step 1.7 for at least partially reducing an oxidising atmosphere in the filled pouch.

8. A method according to claim 1, characterised in that step 1.7 is followed by a drying treatment by means of-hot air or steam.

9. A pouch of foil material for use in a method according to claim 1, including a dimensionally stable insert member (2) sealingly fitted in a slit-like opening of a peripherally sealed pouch based member (1), said insert member having a neck portion (3) defining a through passage (4) and having interlocking means adapted to engage with matching interlocking means on a closure cap (5) for mounting the closure cap on the neck portion of the insert member for closing the through passage, characterized in that the interlocking means on one of said members including the neck portion (3) and the closure cap (5) comprise first and second interlocking portions (14,15) adapted for engaging one after the other with the associated interlocking means (13) on the other member, in such a way that the closure cap is mountable on the neck portion in a first and second sealing position, whereby the closure cap is removable non-destructively from the neck portion at least in the first sealing position.

10. A pouch according to claim 9, characterised in that the interlocking portions comprise a plurality of peripherally spaced interlocking cams (14) and an interlocking collar (15) located axially close thereto on the neck portion (3) of the insert member (2), and the interlocking means on the closure cap (5) comprises an annular collar (13), said annular collar is held in the first sealing position of the closure cap in interlocking engagement with the interlocking cams whilst simultaneously resting on the interlocking collar in sealing manner.

11. A pouch according to claim 9, characterised by means (16) on the neck portion (3)for temporarily holding the pouch in a transporting device of a filling plant.

12. A pouch according to claim 11, characterised in that said holding means comprises a continuous: or discontinuous annular collar (13) on the neck portion (3).

13. A pouch according to claim 11, characterised in that the holding means comprise a plurality of noses projecting from the neck portion (3).

* * * * *